US010650996B2

(12) United States Patent
Hayashida et al.

(10) Patent No.: US 10,650,996 B2
(45) Date of Patent: May 12, 2020

(54) RELAY

(71) Applicant: OMRON CORPORATION, Kyoto-shi, Kyoto (JP)

(72) Inventors: Kaori Hayashida, Yamaga (JP); Yuji Kozai, Kumamoto (JP)

(73) Assignee: OMRON CORPORATION, Kyoto-shi (JP)

( * ) Notice: Subject to any disclaimer, the term of this patent is extended or adjusted under 35 U.S.C. 154(b) by 123 days.

(21) Appl. No.: 15/753,805

(22) PCT Filed: Oct. 3, 2016

(86) PCT No.: PCT/JP2016/079269

§ 371 (c)(1),
(2) Date: Feb. 20, 2018

(87) PCT Pub. No.: WO2017/073244

PCT Pub. Date: May 4, 2017

(65) Prior Publication Data

US 2019/0013172 A1 Jan. 10, 2019

(30) Foreign Application Priority Data

Oct. 29, 2015 (JP) ..... 2015-213039

(51) Int. Cl.
*H01H 50/54* (2006.01)
*H01H 50/58* (2006.01)
(Continued)

(52) U.S. Cl.
CPC ..... *H01H 50/58* (2013.01); *H01H 1/50* (2013.01); *H01H 9/38* (2013.01); *H01H 50/18* (2013.01);
(Continued)

(58) Field of Classification Search
CPC ..... H01H 50/18; H01H 50/56; H01H 50/58; H01H 1/50; H01H 1/54; H01H 1/64; H01H 9/38; H01H 2001/545
(Continued)

(56) References Cited

U.S. PATENT DOCUMENTS 4,328,476 A 5/1982 Bernier
4,551,698 A 11/1985 Aidn
(Continued)

FOREIGN PATENT DOCUMENTS

CN 102723241 A 10/2012
CN 203839295 U 9/2014
(Continued)

OTHER PUBLICATIONS

Chinese Office Action (CNOA) dated Sep. 29, 2018 in a related Chinese patent application.
(Continued)

*Primary Examiner* — Shawki S Ismail
*Assistant Examiner* — Lisa N Homza
(74) *Attorney, Agent, or Firm* — Metrolex IP Law Group, PLLC

(57) ABSTRACT

At the time of contact between the contacts, the first movable contact comes into contact with the first fixed contact before contact between the second movable contact and the second fixed contact is made. The first movable contact is located on a leading end side of the contact piece with respect to the second movable contact. The first divided piece includes a body and a projection. The body extends in the lengthwise direction. The projection projects in the widthwise direction of the first divided piece from the body. The projection includes a contact portion pressed by the link member.

13 Claims, 14 Drawing Sheets

(51) Int. Cl.

| | |
|---|---|
| ***H01H 50/56*** | (2006.01) |
| ***H01H 50/64*** | (2006.01) |
| ***H01H 9/38*** | (2006.01) |
| ***H01H 51/22*** | (2006.01) |
| ***H01H 1/50*** | (2006.01) |
| ***H01H 50/18*** | (2006.01) |

(52) U.S. Cl.
CPC ..... *H01H 50/56* (2013.01); *H01H 50/64* (2013.01); *H01H 50/641* (2013.01); *H01H 51/2227* (2013.01)

(58) Field of Classification Search
USPC ..... 335/2
See application file for complete search history.

(56) References Cited

U.S. PATENT DOCUMENTS

| | | | | |
|---|---|---|---|---|
| 4,571,566 | A | 2/1986 | Saur | |
| 4,703,293 | A | 10/1987 | Ono et al. | |
| 4,731,597 | A | 3/1988 | Hinrichs | |
| 4,743,877 | A | 5/1988 | Oberndorfer et al. | |
| 4,949,058 | A * | 8/1990 | Nishikawa | H01H 50/18 335/128 |
| 5,117,209 | A | 5/1992 | Sato | |
| 5,357,230 | A | 10/1994 | Mikawa | |
| 5,396,204 | A * | 3/1995 | Matsuoka | H01H 50/04 335/78 |
| 5,617,066 | A | 4/1997 | Dittmann et al. | |
| 5,910,759 | A | 6/1999 | Passow | |
| 6,020,801 | A | 2/2000 | Passow | |
| 6,046,661 | A | 4/2000 | Reger et al. | |
| 6,232,858 | B1 * | 5/2001 | Reiter | H01H 50/18 335/128 |
| 6,292,075 | B1 | 9/2001 | Connell et al. | |
| 6,320,485 | B1 | 11/2001 | Gruner | |
| 6,426,689 | B1 | 7/2002 | Nakagawa et al. | |
| 6,661,319 | B2 | 12/2003 | Schmelz | |
| 6,788,176 | B2 | 9/2004 | Schmelz | |
| 6,911,884 | B2 | 6/2005 | Uotome et al. | |
| 6,924,719 | B2 | 8/2005 | Saruwatari et al. | |
| 6,940,375 | B2 | 9/2005 | Sanada et al. | |
| 6,949,997 | B2 | 9/2005 | Bergh et al. | |
| 7,659,800 | B2 | 2/2010 | Gruner et al. | |
| 7,859,370 | B2 | 12/2010 | Shirakawa | |
| 7,982,562 | B2 | 7/2011 | Yang et al. | |
| 8,330,564 | B2 | 12/2012 | Miller | |
| 9,548,172 | B2 | 1/2017 | Hauck et al. | |
| 9,548,173 | B2 | 1/2017 | Connell | |
| 9,741,518 | B2 | 8/2017 | Choi | |
| 9,899,174 | B2 | 2/2018 | Zhang et al. | |
| 10,541,097 | B2 | 1/2020 | Hoffmann | |
| 2002/0135446 | A1 | 9/2002 | Takano et al. | |
| 2004/0080388 | A1 * | 4/2004 | Schmelz | H01H 51/2227 335/128 |
| 2008/0135390 | A1 * | 6/2008 | McCoy | H01H 1/54 200/331 |
| 2009/0033446 | A1 | 2/2009 | Gruner et al. | |
| 2011/0272258 | A1 * | 11/2011 | Miller | H01H 1/54 200/238 |
| 2012/0182097 | A1 * | 7/2012 | Moeller | H01H 50/642 335/71 |
| 2014/0225688 | A1 | 8/2014 | Masui et al. | |
| 2015/0002248 | A1 * | 1/2015 | Iwamoto | H01H 3/001 335/192 |
| 2015/0042423 | A1 | 2/2015 | Hoffmann et al. | |
| 2015/0042425 | A1 * | 2/2015 | Sumino | H01H 50/643 335/189 |
| 2015/0123750 | A1 * | 5/2015 | Pan | H01H 50/08 335/2 |
| 2015/0325385 | A1 * | 11/2015 | Kinoshita | H01H 9/46 335/189 |
| 2015/0325390 | A1 * | 11/2015 | Kinoshita | H01H 9/443 335/201 |
| 2015/0325398 | A1 * | 11/2015 | Nakahara | H01H 50/642 335/192 |
| 2015/0325399 | A1 * | 11/2015 | Kinoshita | H01H 50/641 335/189 |
| 2016/0012997 | A1 | 1/2016 | Neuhaus et al. | |
| 2018/0240631 | A1 * | 8/2018 | Hayashida | H01H 50/56 |
| 2018/0269018 | A1 * | 9/2018 | Shimoda | H01H 50/20 |
| 2018/0358186 | A1 * | 12/2018 | Hayashida | H01H 1/54 |
| 2019/0013172 | A1 * | 1/2019 | Hayashida | H01H 50/56 |

FOREIGN PATENT DOCUMENTS

| | | | |
|---|---|---|---|
| CN | 104282493 | A | 1/2015 |
| CN | 104508787 | A | 4/2015 |
| CN | 204464182 | U | 7/2015 |
| CN | 204596721 | U | 8/2015 |
| CN | 104969325 | A | 10/2015 |
| EP | 1511052 | B1 | 11/2007 |
| EP | 2782110 | A1 | 9/2014 |
| EP | 2822011 | A1 | 1/2015 |
| EP | 2394284 | B1 | 4/2016 |
| EP | 3021342 | A1 | 5/2016 |
| EP | 3089190 | A1 | 11/2016 |
| EP | 3113204 | A1 | 1/2017 |
| JP | S32-7501 | Y1 | 7/1957 |
| JP | S56-100819 | U | 8/1981 |
| JP | S58-71918 | U | 5/1983 |
| JP | S58-182321 | U | 12/1983 |
| JP | S59-111219 | A | 6/1984 |
| JP | S59-126443 | U | 8/1984 |
| JP | 2005-183097 | A | 7/2005 |
| JP | 2009-224150 | A | 10/2009 |
| JP | 2012-517092 | A | 7/2012 |
| JP | 2012-212667 | A | 11/2012 |
| JP | 2013-41764 | A | 2/2013 |
| JP | 5741679 | B1 | 7/2015 |
| JP | 2015-159025 | A | 9/2015 |
| JP | 2015-216053 | A | 12/2015 |
| WO | 2015/005082 | A1 | 1/2015 |
| WO | 2015/005313 | A1 | 1/2015 |
| WO | 2015/045738 | A1 | 4/2015 |
| WO | 2015/098171 | A1 | 7/2015 |
| WO | 2015/125319 | A1 | 8/2015 |

OTHER PUBLICATIONS

Chinese Office Action (CNOA) dated Jun. 11, 2019 in a counterpart Chinese patent application.
Chinese Office Action (CNOA) dated Nov. 19, 2018 in a related Chinese patent application.
English translation of the International Search Report of PCT/JP2016/079256 dated Nov. 8, 2016.
English translation of the Written Opinion of PCT/JP2016/079256 dated Nov. 8, 2016.
English translation of the International Search Report of PCT/JP2016/079237 dated Nov. 22, 2016.
English translation of the Written Opinion of PCT/JP2016/079237 dated Nov. 22, 2016.
English translation of the International Search Report of PCT/JP2016/079269 dated Nov. 22, 2016.
English translation of the Written Opinion of PCT/JP2016/079269 dated Nov. 22, 2016.
Chinese Office Action (CNOA) dated Dec. 5, 2018 in a counterpart Chinese patent application.
The German Office Action dated Oct. 23, 2019 in a counterpart German patent application.
The Indian Office Action dated Dec. 9, 2019 in a counterpart Indian patent application.
The Indian Office Action dated Jan. 29, 2020 in a related Indian patent application.
The U.S. Office Action dated Mar. 5, 2020 in a related U.S. Appl. No. 15/754,172.

(56) References Cited

OTHER PUBLICATIONS

The U.S. Office Action dated Feb. 28, 2020 in a related U.S. Appl. No. 15/754,056.

* cited by examiner

RELAY

TECHNICAL FIELD

The present invention relates to a relay.

BACKGROUND ART

There is known a relay which includes a plurality of movable contacts and a plurality of fixed contacts. For example, a contact piece of a relay disclosed in Patent Document 1 includes a first divided piece and a second divided piece. An open/close movable contact is attached to the first divided piece, while an energization movable contact is attached to the second divided piece. An open/close fixed contact and an energization fixed contact are attached to a fixed contact terminal.

According to the relay described above, a height of the open/close movable contact from the contact piece is larger than a height of the energization movable contact from the contact piece. Accordingly, at the time of switching from a reset state to a set state of the relay, the energization movable contact and the energization fixed contact come into contact with each other after the open/close movable contact and the open/close fixed contact come into contact with each other. On the other hand, at the time of switching from the set state to the reset state of the relay, the open/close movable contact and the open/close fixed contact separate from each other to cut off a load after the energization movable contact and the energization fixed contact separate from each other.

According to the relay described above, therefore, the open/close movable contact and the open/close fixed contact achieve opening or closing of a load, while the energization movable contact and the energization fixed contact achieve not opening or closing of a load, but only energization. This configuration reduces generation of an arc between the energization movable contact and the energization fixed contact, even at the time of generation of an arc between the open/close movable contact and the open/close fixed contact.

PRIOR ART DOCUMENT

Patent Document

Patent Document 1: Japanese Patent No. 5741679

SUMMARY OF THE INVENTION

Problems to be Solved by the Invention

When an arc is generated between the open/close movable contact and the open/close fixed contact, the open/close movable contact may be welded to the open/close fixed contact. In this case, a link member provided to operate the contact piece presses the first divided piece to detach the open/close movable contact from the open/close fixed contact. It is preferable to increase this detaching force to improve operation stability of the relay.

An object of the present invention is to increase detaching force for detaching an open/close movable contact from an open/close fixed contact at the time of welding between the open/close movable contact and the open/close fixed contact to improve operation stability of a relay.

Means for Solving the Problem

A relay according to an aspect of the present invention includes a movable contact terminal, a contact piece, a first movable contact, a second movable contact, a fixed contact terminal, a first fixed contact, a second fixed contact, and a link member. The contact piece is attached to the movable contact terminal, and includes a first divided piece and a second divided piece. The first divided piece and the second divided piece are each extended in a lengthwise direction, and divided from each other. The first movable contact is attached to the first divided piece. The second movable contact is attached to the second divided piece. The fixed contact terminal is disposed at a position facing the contact piece. The first fixed contact is attached to the fixed contact terminal, and disposed at a position facing the first movable contact. The second fixed contact is attached to the fixed contact terminal, and disposed at a position facing the second movable contact. The link member is capable of pressing the contact piece.

At the time of contact between the contacts, the first movable contact comes into contact with the first fixed contact before contact between the second movable contact and the second fixed contact is made. The first movable contact is located on a leading end side of the contact piece with respect to the second movable contact. The first divided piece includes a body and a projection. The body extends in the lengthwise direction. The projection projects in the widthwise direction of the first divided piece from the body. The projection includes a contact portion pressed by the link member.

In the relay according to the aspect, the first movable contact functions as an open/close movable contact, while the second movable contact functions as an energization movable contact. The first movable contact is located on a leading end side of the contact piece with respect to the second movable contact. In this case, the first movable contact can be largely displaced when the link member presses the contact piece. Accordingly, detaching force for detaching the first movable contact from the first fixed contact can be increased.

Moreover, the contact portion is provided on the projection projecting in the widthwise direction of the first divided piece from the body. In this case, a distance between the contact portion and the first movable contact can be increased. Accordingly, the detaching force applied to the first movable contact by press of the link member against the contact portion can be increased, whereby the detaching force can be increased.

The contact portion may be disposed at a position deviating in the widthwise direction from the first movable contact. In this case, the detaching force can be further increased by twisting deformation of the first divided piece.

The contact portion may be located at a portion of the first divided piece on a leading end side with respect to at least a part of the first movable contact. In this case, the detaching force can be further increased by large displacement of the first movable contact.

The contact portion may be provided at a leading end of the first divided piece. In this case, the detaching force can be further increased by large displacement of the first movable contact.

The second divided piece may include a recess provided at a position facing the projection. This configuration reduces increase in the width of the contact piece.

The relay may further include a wall. The wall is projected from a surface of the fixed contact terminal, and disposed between the first fixed contact and the second fixed contact. In this case, the wall reduces adhesion of scatterings from the first movable contact and the first fixed contact to the second movable contact and the second fixed contact at the time of generation of an arc between the first movable contact and the first fixed contact. Accordingly, contact stability between the second movable contact and the second fixed contact can be improved.

A height of the wall from the surface of the fixed contact terminal may be larger than a height of the first fixed contact, or a height of the second fixed contact. This configuration further reduces adhesion of scatterings to the second movable contact and the second fixed contact.

The height of the wall may be smaller than a distance between the contact piece and the fixed contact terminal in a state of contact between the first movable contact and the first fixed contact. This configuration reduces interference between the wall and the contact piece.

The wall may include a curved portion curved in such a shape as to surround the second fixed contact. This configuration secures a wide space for an arc generable area around the first fixed contact and the first movable contact. Accordingly, electric durability between the first fixed contact and the first movable contact can be improved.

A virtual line that connects a center of the first fixed contact and a center of the second fixed contact may overlap with the curved portion as viewed in a direction perpendicular to the surface of the fixed contact terminal. In this case, the curved portion is located between the center of the first fixed contact and the center of the second fixed contact. Accordingly, a wide space can be secured around the first fixed contact and the first movable contact.

The wall may be projected from a surface of the contact piece, and disposed between the first movable contact and the second movable contact. In this case, the wall reduces adhesion of scatterings from the first movable contact and the first fixed contact to the second movable contact and the second fixed contact at the time of generation of an arc between the first movable contact and the first fixed contact. Accordingly, contact stability between the second movable contact and the second fixed contact can be improved.

A height of the first movable contact from the contact piece may be larger than a height of the second movable contact from the contact piece. This configuration brings the second movable contact into contact with the second fixed contact after contact between the first movable contact and the first fixed contact is made.

A height of the first fixed contact from the fixed contact terminal may be larger than a height of the second fixed contact from the fixed contact terminal. This configuration brings the second movable contact into contact with the second fixed contact after contact between the first movable contact and the first fixed contact is made.

Effect of the Invention

According to the present invention, operation stability of a relay can be improved by increasing detaching force for detaching an open/close movable contact from an open/close fixed contact at the time of welding between the open/close movable contact and the open/close fixed contact.

MODE FOR CARRYING OUT THE INVENTION

Figure 1:
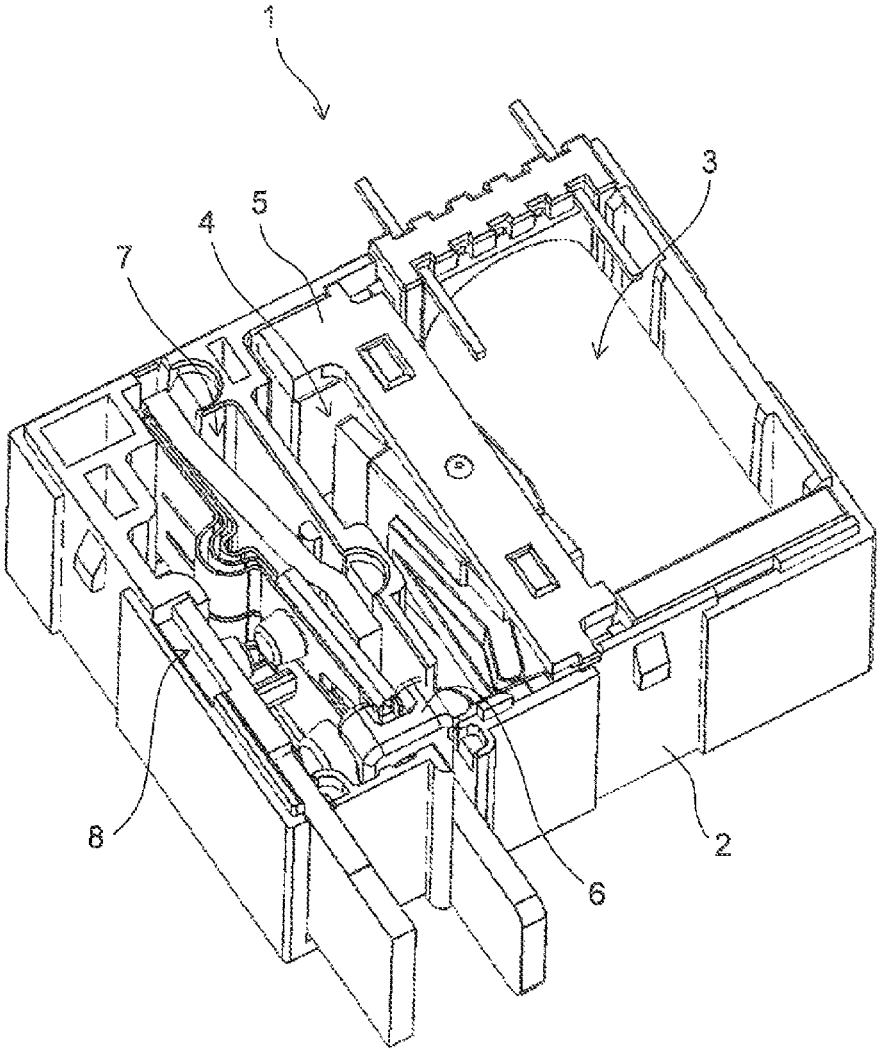
FIG. 1 is a perspective view of a relay according to an embodiment.
Figure 2:
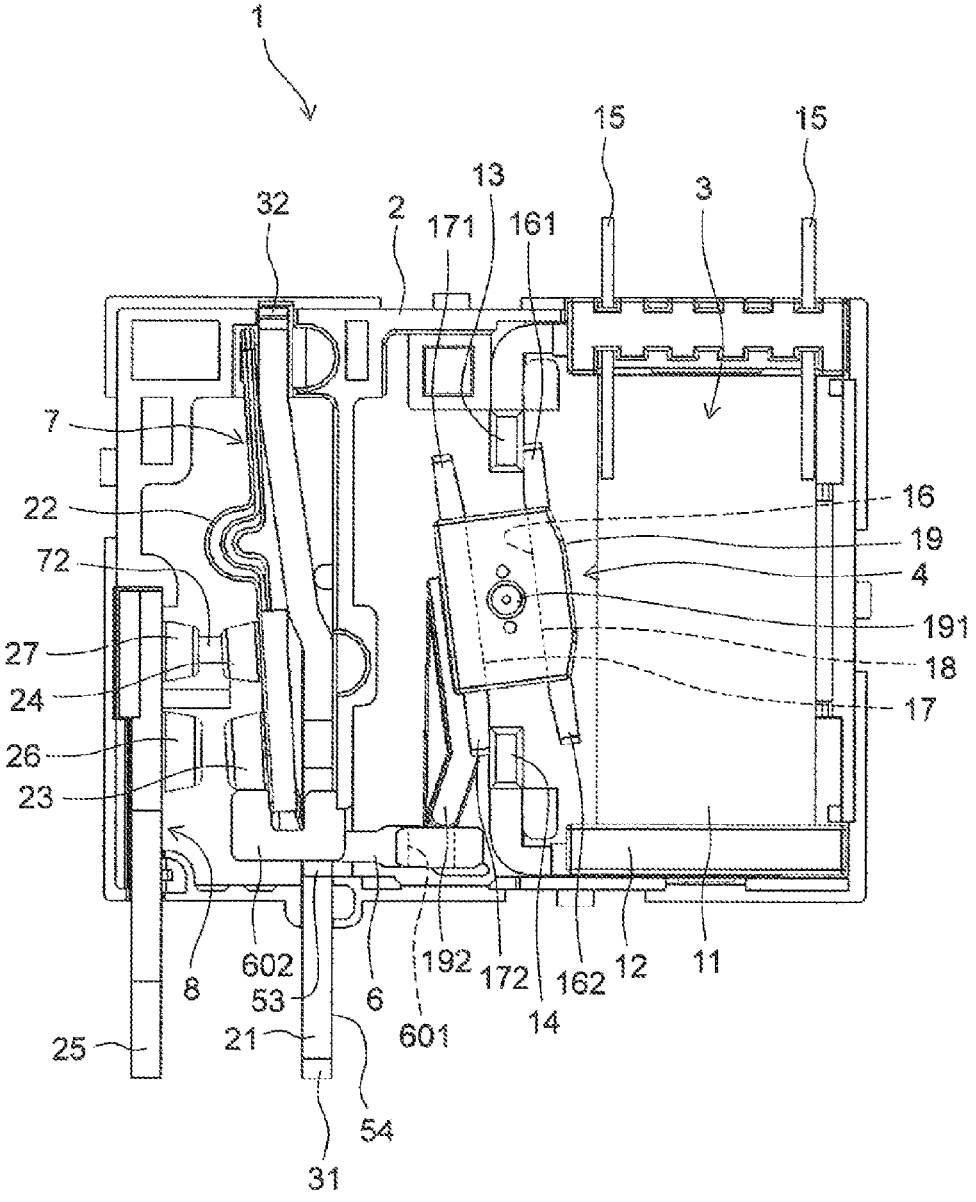
FIG. 2 is a plan view of the relay in a reset state.
Figure 3:
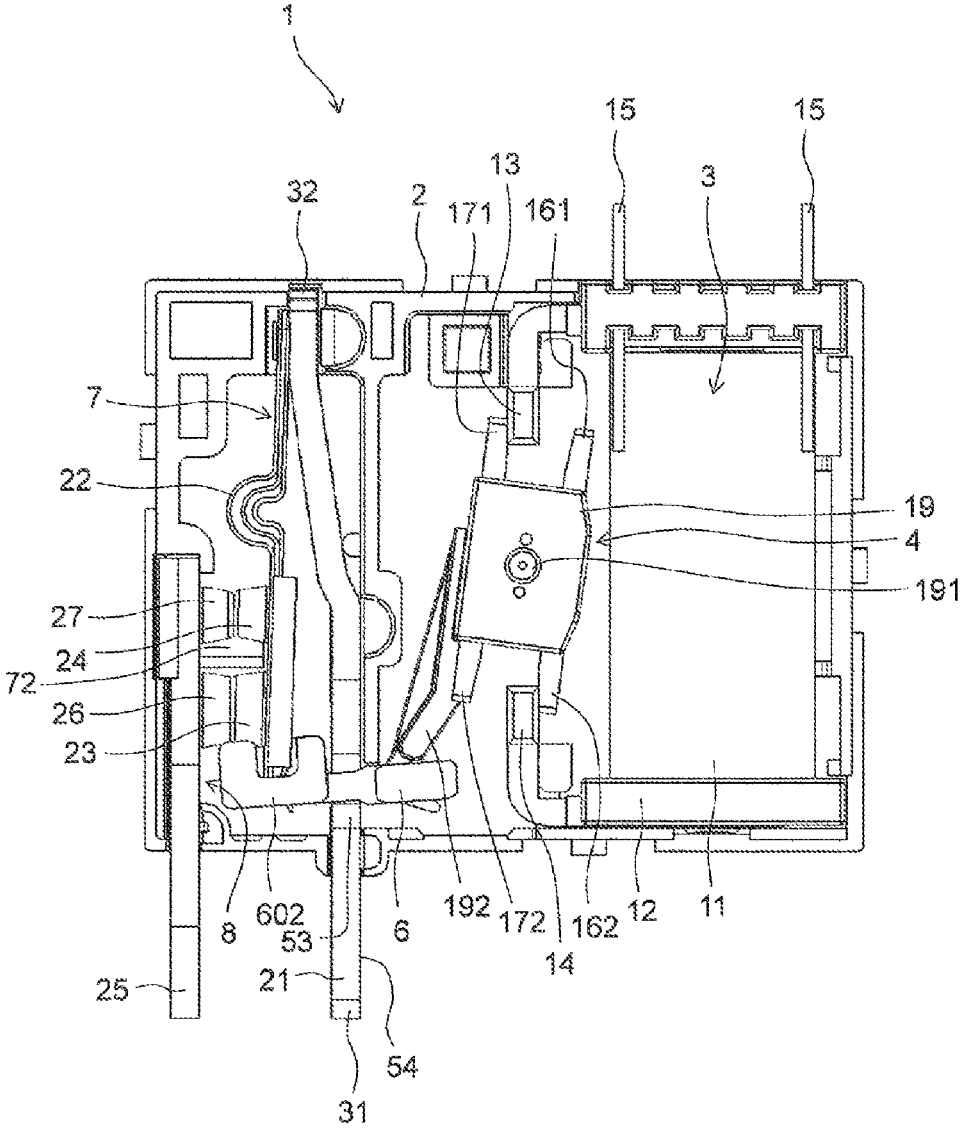
FIG. 3 is a plan view of the relay in a set state.

A relay according to an embodiment is hereinafter described with reference to the drawings. FIG. 1 is a perspective view of a relay 1 according to the embodiment. FIG. 2 is a plan view of the relay 1 in a reset state. FIG. 3 is a plan view of the relay 1 in a set state. The relay 1 includes a base 2, a driving unit 3, a movable unit 4, a support member 5, a link member 6, a contact piece unit 7, and a fixed contact unit 8. The support member 5 is not shown in FIGS. 2 and 3.

The base 2 houses the driving unit 3, the movable unit 4, the link member 6, the contact piece unit 7, and the fixed contact unit 8. A not-shown cover member is attached to the base 2.

The driving unit 3 drives the movable unit 4. The driving unit 3 generates electromagnetic force for rotating the movable unit 4. As illustrated in FIG. 2, the driving unit 3 includes a coil 11, a spool 12, a first yoke 13, and a second yoke 14. The coil 11 is wound around the spool 12. A coil terminal 15 is attached to the coil 11 such that the coil 11 can be energized via the coil terminal 15. A not-shown iron core is inserted into the spool 12. The first yoke 13 is connected with one end of the iron core, while the second yoke 14 is connected with the other end of the iron core.

The movable unit 4 is rotatably supported relative to the base 2. The movable unit 4 is disposed between the first yoke 13 and the second yoke 14. The movable unit 4 includes a first armature 16, a second armature 17, a permanent magnet 18, and a movable body 19. The first armature 16, the second armature 17, and the permanent magnet 18 are attached to the movable body 19. The movable body 19 is rotatably supported on the base 2 around a rotation shaft 191. The movable body 19 includes an arm 192. The arm 192 extends toward the link member 6.

The first armature 16 includes a first end 161 and a second end 162. The second armature 17 includes a third end 171 and a fourth end 172. The first end 161 and the third end 171 project in the same direction from the movable body 19. The second end 162 and the fourth end 172 project in the direction opposite to the projection direction of the first end 161 and the third end 171 from the movable body 19.

The link member 6 connects the movable body 19 and the contact piece unit 7. The link member 6 is so disposed as to cross a movable contact terminal 21 of the contact piece unit 7 described below in plan view. One end of the link member 6 is connected with the movable body 19. The other end of the link member 6 is connected with the contact piece unit 7. More specifically, the link member 6 includes a connection hole 601. A leading end of the arm 192 of the movable body 19 is disposed in the connection hole 601. This configuration latches the arm 192 to the link member 6 during driving of the link member 6 by the movable body 19.

The link member 6 further includes a pressing portion 602. The pressing portion 602 is so disposed as to surround a leading end of a contact piece 22 of the contact piece unit 7 described below. This configuration latches the pressing portion 602 to the leading end of the contact piece 22 during driving of the link member 6 by the movable body 19.

The contact piece unit 7 includes a movable contact terminal 21, a contact piece 22, and movable contacts 23 and 24. The contact piece 22 is connected with the movable contact terminal 21. The contact piece 22 is disposed at a position facing the movable contact terminal 21. The movable contacts 23 and 24 are attached to the contact piece 22. The link member 6 described above is capable of pressing the contact piece 22. The contact piece unit 7 will be detailed below.

The fixed contact unit 8 includes a fixed contact terminal 25 and fixed contacts 26 and 27. The fixed contact terminal 25 is disposed at a position facing the contact piece 22. The fixed contacts 26 and 27 are attached to the fixed contact terminal 25. The fixed contacts 26 and 27 are disposed at positions facing the movable contacts 23 and 24, respectively. The fixed contact unit 8 will be described in detail below.

Next, an operation of the relay 1 is described. In the reset state illustrated in FIG. 2, the first end 161 of the first armature 16 contacts the first yoke 13, while the second end 162 separates from the second yoke 14. The fourth end 172 of the second armature 17 contacts the second yoke 14, while the third end 171 separates from the first yoke 13. The movable contacts 23 and 24 separate from the fixed contacts 26 and 27, respectively.

When the coil 11 is energized in a predetermined direction, electromagnetic force is generated to rotate the movable unit 4 in a predetermined forward direction (clockwise in FIG. 2). The movable unit 4 therefore rotates in the forward direction. The link member 6 moves in the left direction in FIG. 2 in accordance with rotation of the movable unit 4 in the forward direction. In this case, a leading end of the contact piece 22 moves in the left direction in FIG. 2, and accordingly, the movable contacts 23 and 24 move toward the fixed contacts 26 and 27. The movable contacts 23 and 24 therefore come into contact with the fixed contacts 26 and 27. As a result, the reset state of the relay 1 illustrated in FIG. 2 is switched to the set state illustrated in FIG. 3.

In the set state, the first end 161 of the first armature 16 separates from the first yoke 13, while the second end 162 contacts the second yoke 14 as illustrated in FIG. 3. In addition, the fourth end 172 of the second armature 17 separates from the second yoke 14, while the third end 171 contacts the first yoke 13. The set state is maintained by magnetic force of the permanent magnet 18 even at a stop of energization of the coil 11 in this state.

When the coil 11 is subsequently energized in the direction opposite to the foregoing predetermined direction, electromagnetic force is generated to rotate the movable unit 4 in the direction opposite to the foregoing forward direction (anticlockwise in FIG. 3). As a result, the movable unit 4 rotates in the opposite direction. The link member 6 moves in the right direction in FIG. 3 in accordance with the rotation of the movable unit 4 in the opposite direction. In this case, the leading end of the contact piece unit 7 moves in the right direction in FIG. 3, and accordingly, the movable contacts 23 and 24 move away from the fixed contacts 26 and 27, respectively. The movable contacts 23 and 24 therefore separate from the fixed contacts 26 and 27, respectively. As a result, the set state of the relay 1 illustrated in FIG. 3 is switched to the reset state illustrated in FIG. 2. The reset state is maintained by magnetic force of the permanent magnet 18 even at a stop of energization of the coil 11 in this state.

Figure 4:
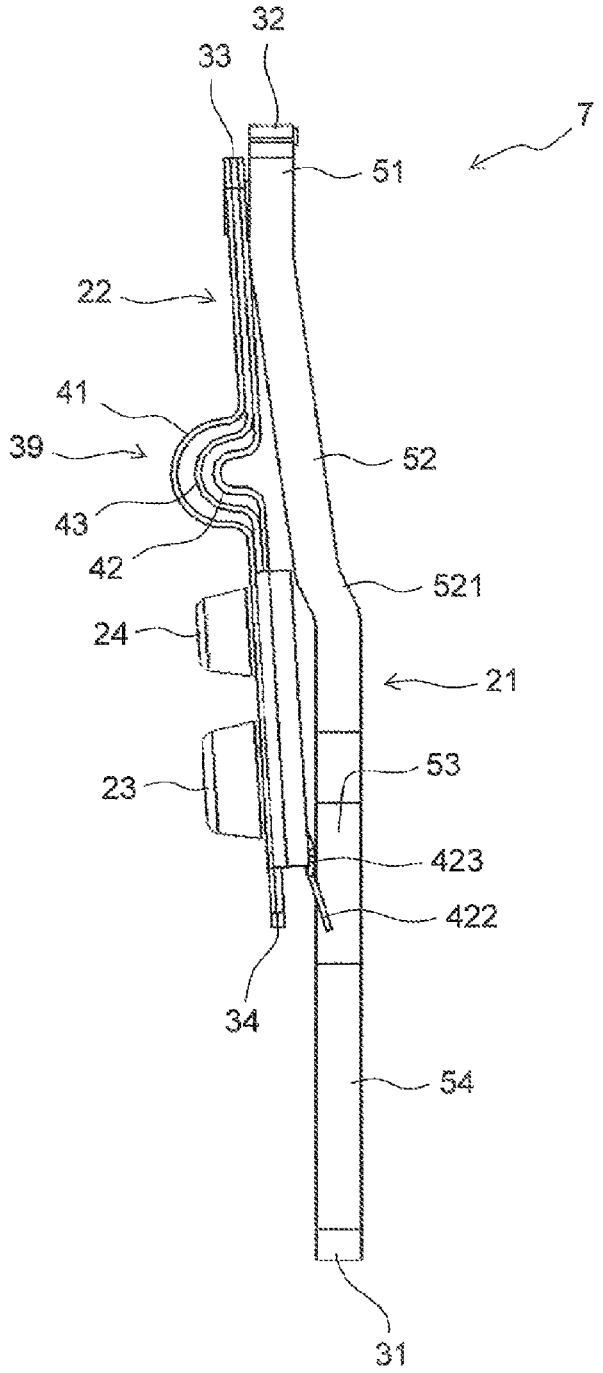
FIG. 4 is a plan view of a contact piece unit according to the embodiment.
Figure 5:
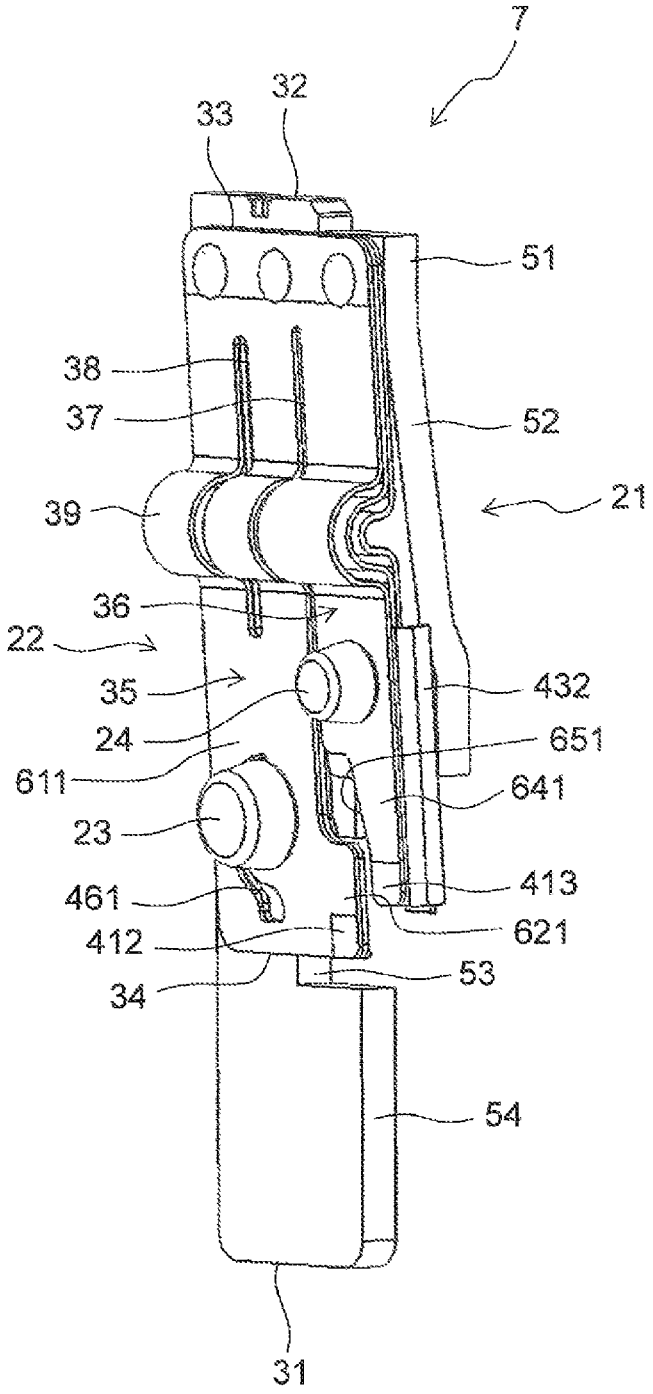
FIG. 5 is a perspective view of the contact piece unit.
Figure 6:
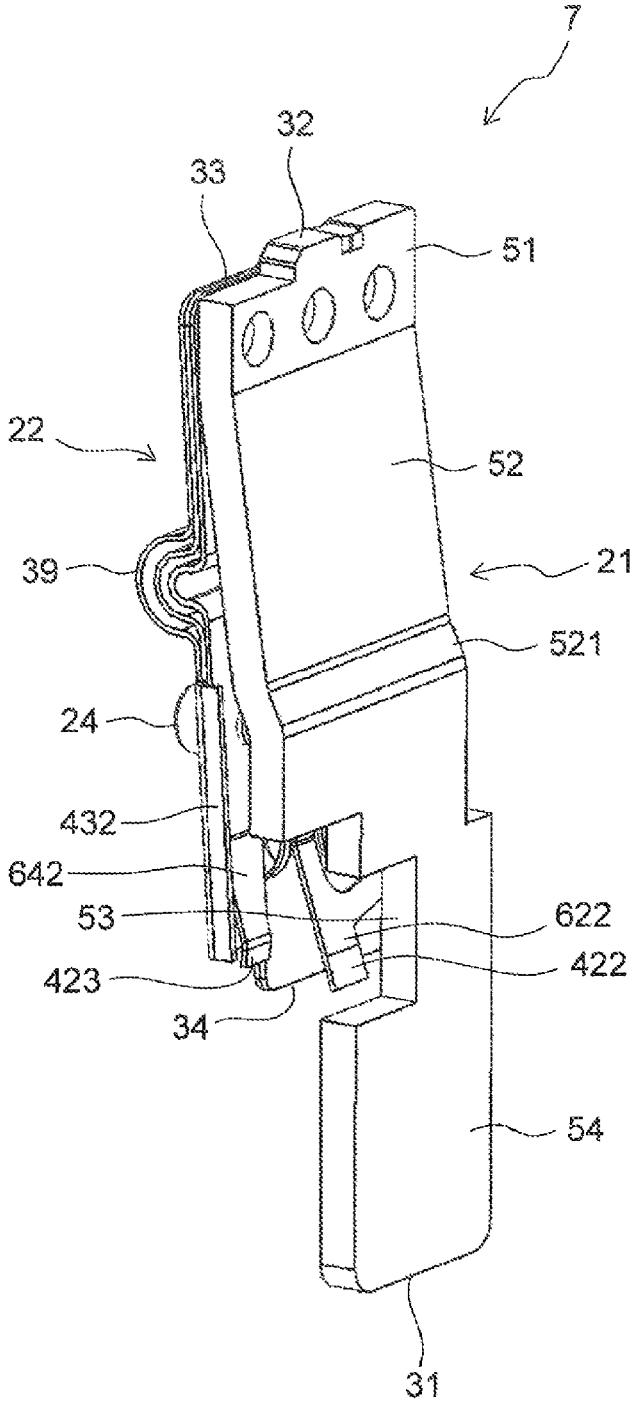
FIG. 6 is a perspective view of the contact piece unit.
Figure 7:
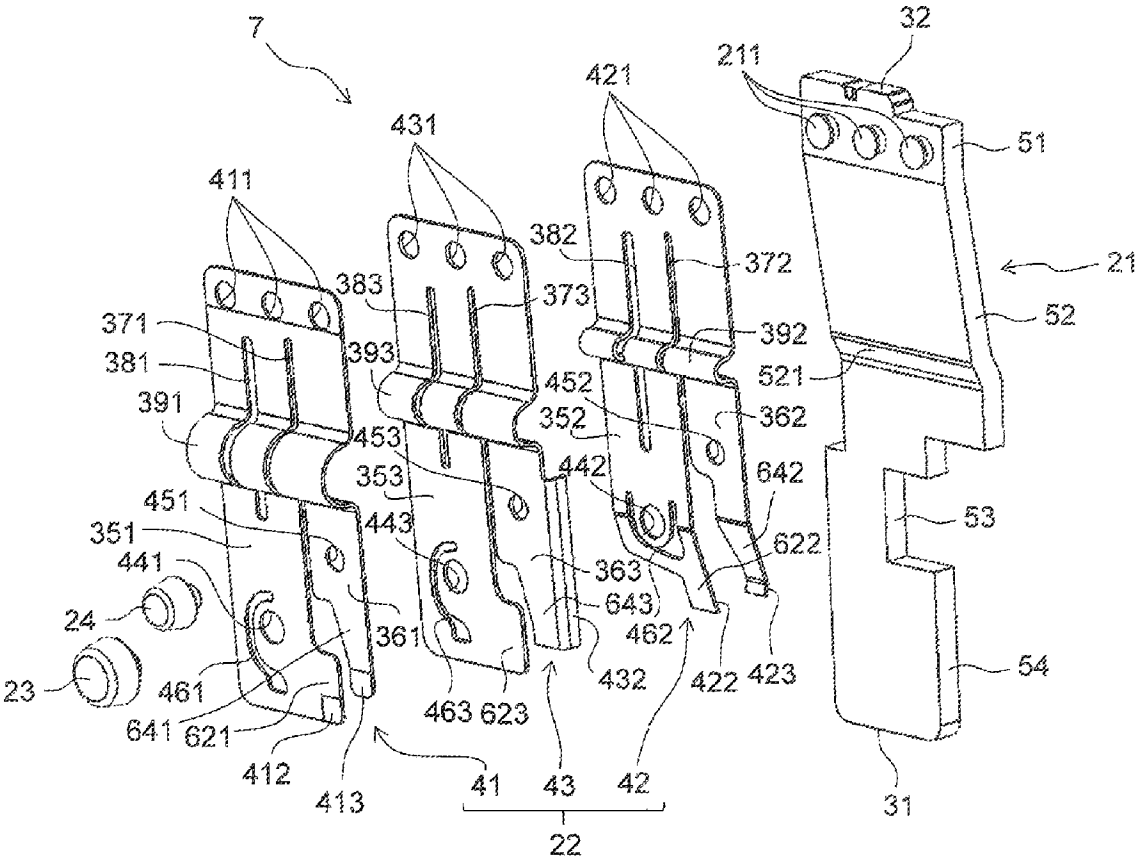
FIG. 7 is an exploded perspective view of the contact piece unit.
Figure 8:
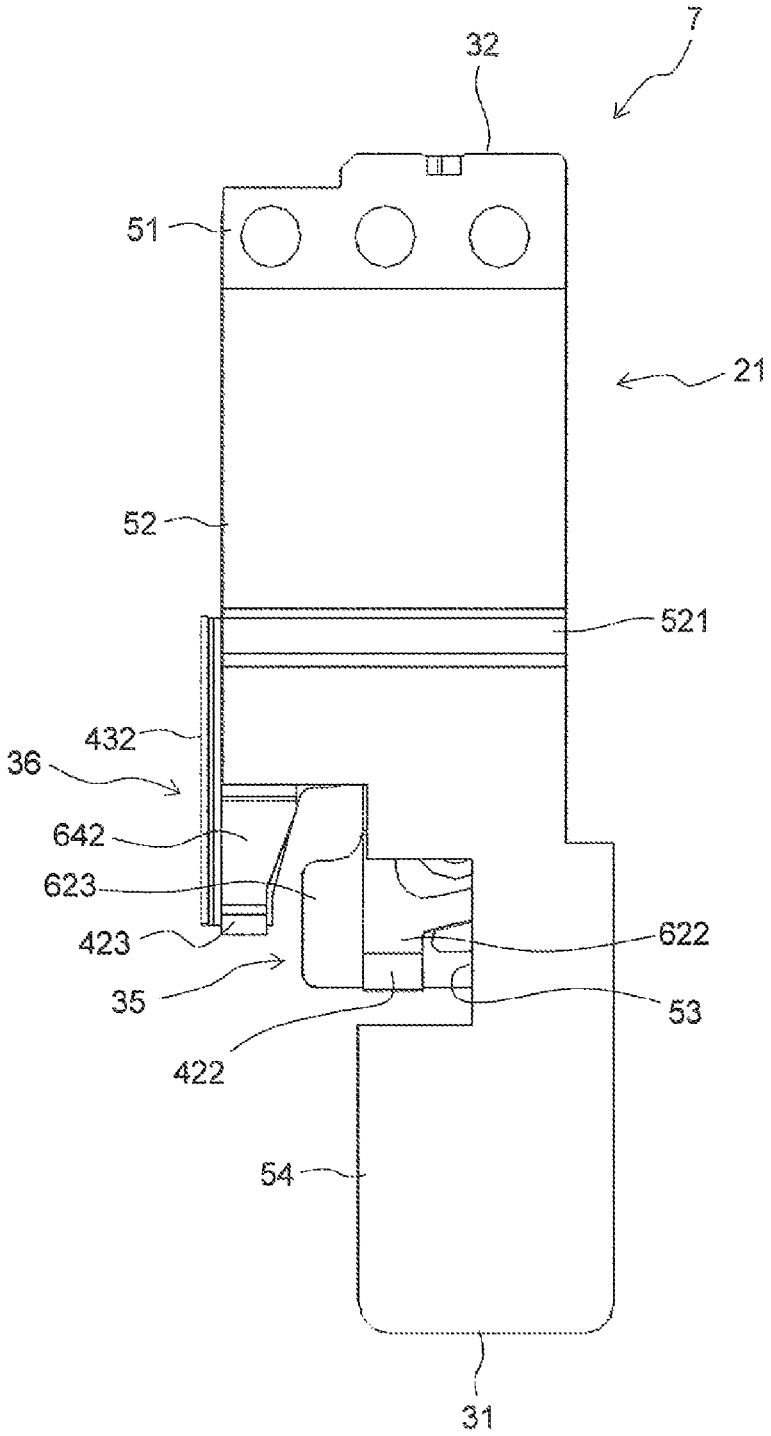
FIG. 8 is a side view of the contact piece unit.
Figure 9:
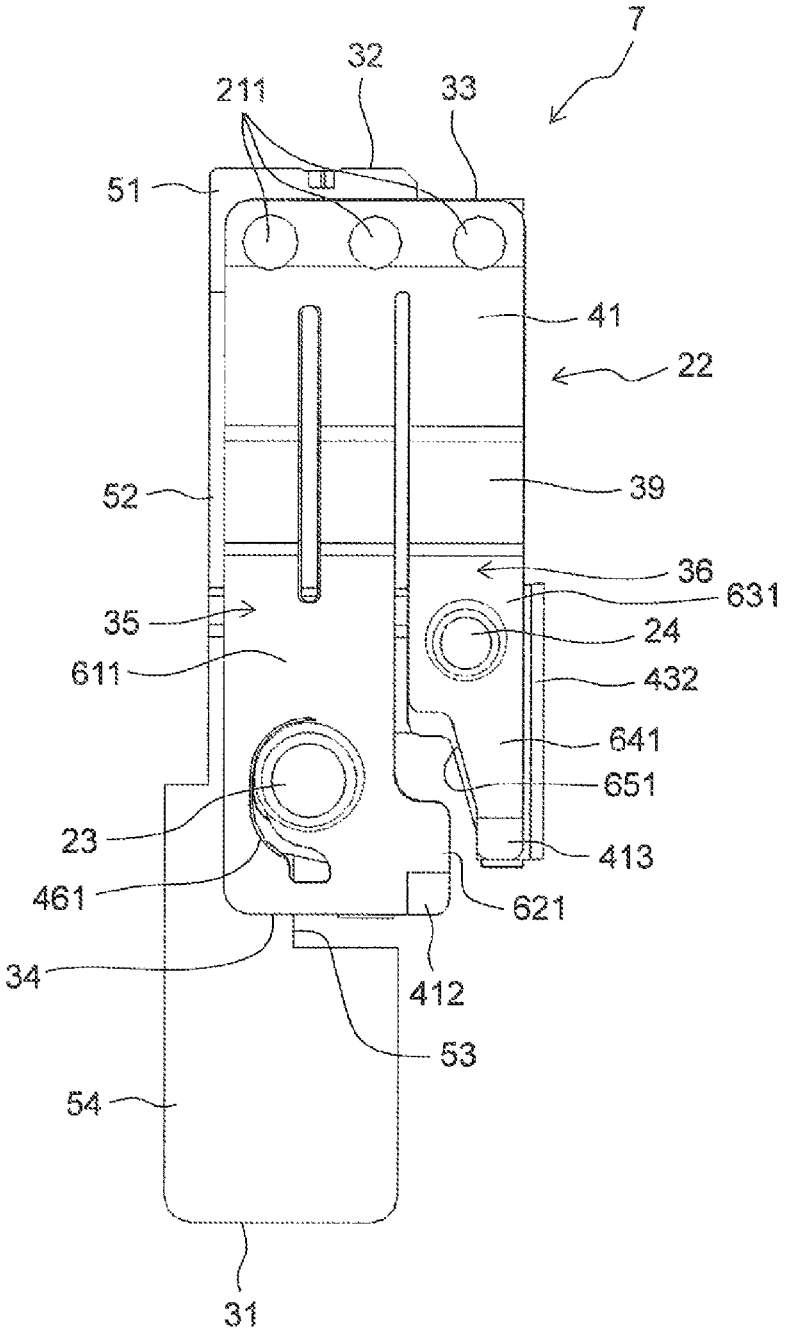
FIG. 9 is a side view of the contact piece unit.

Next, the contact piece unit 7 is described. FIG. 4 is a plan view of the contact piece unit 7. FIGS. 5 and 6 are perspective views of the contact piece unit 7. FIG. 7 is an exploded perspective view of the contact piece unit 7. FIG. 8 is a side view of the contact piece unit 7 as viewed from the movable contact terminal 21 side. FIG. 9 is a side view of the contact piece unit 7 as viewed from the contact piece 22 side.

As illustrated in FIGS. 4 to 9, the movable contact terminal 21 has an elongate plate shape. The movable contact terminal 21 includes a leading end portion 31 and a proximal end portion 32. As illustrated in FIG. 2, the leading end portion 31 of the movable contact terminal 21 is so disposed as to project to the outside of the base 2. The proximal end portion 32 of the movable contact terminal 21 is disposed inside the base 2.

According to the embodiment, a direction in parallel to a direction extending from the proximal end portion 32 toward the leading end portion 31 is referred to as a lengthwise direction. The lengthwise direction corresponds to an up-down direction in FIG. 4. A direction perpendicular to the lengthwise direction and a plate thickness direction of the movable contact terminal 21 is referred to as a widthwise direction. The plate thickness direction of the movable contact terminal 21 corresponds to a right-left direction in FIG. 4. The widthwise direction is a direction perpendicular to the sheet of FIG. 4, and corresponds to a right-left direction in FIGS. 8 and 9.

The movable contacts 23 and 24 include the first movable contact 23 and the second movable contact 24, respectively. The first movable contact 23 and the second movable contact 24 are separated from each other in the lengthwise direction of the contact piece 22. More specifically, the first movable contact 23 is located at the leading end side of the contact piece 22 with respect to the second movable contact 24. A diameter of the first movable contact 23 is larger than a diameter of the second movable contact 24. A height of the first movable contact 23 from the contact piece 22 is larger than a height of the second movable contact 24 from the contact piece 22. The number of the movable contacts is not limited to two, but may be a number larger than two.

The contact piece 22 is connected with the proximal end portion 32 of the movable contact terminal 21. The contact piece 22 has a plate shape elongated in the lengthwise direction of the movable contact terminal 21. The contact piece 22 has a proximal end portion 33 and a leading end portion 34. The proximal end portion 33 of the contact piece 22 is joined to the movable contact terminal 21. The leading end portion 34 of the contact piece 22 is a free end located on the side opposite to the proximal end portion 33. Accordingly, the proximal end portion 33 of the contact piece 22 is supported on the movable contact terminal 21 in a cantilevered manner.

As illustrated in FIG. 5, the contact piece 22 includes a first divided piece 35 and a second divided piece 36. The contact piece 22 includes a slit 37 formed between the first divided piece 35 and the second divided piece 36. The first divided piece 35 and the second divided piece 36 are separated from each other by the slit 37. The slit 37 extends lengthwise from the leading end portion 34 of the contact piece 22 toward the proximal end portion 33. The slit 37 does not reach the proximal end portion 33. The first divided piece 35 and the second divided piece 36 are therefore connected with each other at the proximal end side of the slit 37. The first movable contact 23 is attached to the first divided piece 35. The second movable contact 24 is attached to the second divided piece 36.

The first divided piece 35 includes a slit 38. The slit 38 is formed between the first movable contact 23, and a portion connected with the movable contact terminal 21. A width of the first divided piece 35 is larger than a width of the second divided piece 36. A leading end of the first divided piece 35 is located on a leading end side of the movable contact terminal 21 with respect to a leading end of the second divided piece 36.

As illustrated in FIG. 9, the first divided piece 35 includes a first contact portion 412. The first contact portion 412 is provided at a leading end portion of the first divided piece 35. The first contact portion 412 is provided on a surface at the fixed contact terminal 25 side of the first divided piece 35.

More specifically, the first divided piece 35 includes a first body 611 and a projection 621. The first body 611 extends in the lengthwise direction. The first movable contact 23 is attached to the first body 611. The projection 621 projects in the widthwise direction from the first body 611. The projection 621 projects in the widthwise direction toward the second divided piece 36 from the first divided piece 35. The first contact portion 412 is provided on the projection 621.

The first contact portion 412 is located at a portion of the first divided piece 35 on a leading end side with respect to the first movable contact 23. The first contact portion 412 is provided at a corner of the leading end of the first divided piece 35. The first contact portion 412 deviates in the widthwise direction from the position of the first movable contact 23.

The first divided piece 35 includes a first slit 461. The first slit 461 is disposed around the first movable contact 23. The first slit 461 has a shape curved along the first movable contact 23. The first slit 461 is disposed on a side opposite to the projection 621 with respect to the first movable contact 23.

The second divided piece 36 includes a second body 631 and a tapered portion 641. The second body 631 extends in the lengthwise direction. The second movable contact 24 is attached to the second body 631. The tapered portion 641 is located on a leading end side of the second body 631. The tapered portion 641 is so shaped as to decrease in width with nearness to the leading end.

The second divided piece 36 includes a recess 651 at a portion containing the tapered portion 641. The recess 651 is disposed at a position facing the projection 621 of the first divided piece 35. The recess 651 has a shape recessed to avoid overlap with the projection 621. The recess 651 is disposed at a position facing the first movable contact 23 in the widthwise direction. The second movable contact 24 is located at a portion of the second divided piece 36 on a proximal end side with respect to the recess 651.

The second divided piece 36 includes a second contact portion 413. The second contact portion 413 is provided on a surface at the fixed contact terminal 25 side of the second divided piece 36. The second contact portion 413 is disposed at a position facing the projection 621 in the widthwise direction. The second contact portion 413 is provided at a leading end of the second divided piece 36. In other words, the second contact portion 413 is provided at a leading end of the tapered portion 641. The first divided piece 35 is longer than the second divided piece 36 in the lengthwise direction. Accordingly, the first contact portion 412 is located on the leading end side with respect to the second contact portion 413.

The link member 6 presses the first contact portion 412 and the second contact portion 413 to move the movable contacts 23 and 24 in directions away from the fixed contacts 26 and 27 and thereby separate the movable contacts 23 and 24 from the fixed contacts 26 and 27. As a result, the set state of the relay 1 is switched to the reset state.

As illustrated in FIG. 8, the first divided piece 35 includes a third contact portion 422. The third contact portion 422 is provided at the leading end of the first divided piece 35. The third contact portion 422 is provided on a surface at the movable contact terminal 21 side of the first divided piece 35. The second divided piece 36 includes a fourth contact portion 423. The fourth contact portion 423 is provided at a leading end of the second divided piece 362. The fourth contact portion 423 is provided on a surface at the movable contact terminal 21 side of the second divided piece 362.

The link member 6 presses the third contact portion 422 and the fourth contact portion 423 to move the movable contacts 23 and 24 toward the fixed contacts 26 and 27, respectively, and bring the movable contacts 23 and 24 into contact with the fixed contacts 26 and 27. As a result, the reset state of the relay 1 is switched to the set state.

As illustrated in FIG. 5, the contact piece 22 includes an expanded portion 39. The expanded portion 39 has a curved shape protruding in a direction away from the movable contact terminal 21. The expanded portion 39 projects from the movable contacts 23 and 24 toward the fixed contacts 26 and 27. The expanded portion 39 extends in the widthwise direction of the contact piece 22. The expanded portion 39 is located between the proximal end portion 33 of the contact piece 22 and the movable contacts 23 and 24 in the lengthwise direction of the contact piece 22.

As illustrated in FIG. 7, the contact piece unit 7 includes a plurality of leaf springs 41 to 43. The plurality of leaf springs 41 to 43 are laminated on each other. More specifically, the contact piece unit 7 includes the first leaf spring 41, the second leaf spring 42, and the third leaf spring 43. In the plurality of leaf springs 41 to 43, the first leaf spring 41 is disposed at a position farthest from the movable contact terminal 21. In the plurality of leaf springs 41 to 43, the second leaf spring 42 is disposed at a position closest to the movable contact terminal 21. The third leaf spring 43 is disposed between the first leaf spring 41 and the second leaf spring 42.

The number of the leaf springs is not limited to three, but may be a number smaller than three. Alternatively, the number of the leaf springs may be a number larger than three.

The first leaf spring 41 includes connection holes 411. The second leaf spring 42 includes connection holes 421. The third leaf spring 43 includes connection holes 431. The movable contact terminal 21 includes a connection projection 211. The connection projection 211 is inserted into the connection holes 411, 421, and 431 of the first to third leaf springs 41 to 43 to connect the first to third leaf springs 41 to 43 and the movable contact terminal 21 integrally.

The first leaf spring 41 includes a first divided piece 351 and a second divided piece 361. The second leaf spring 42 includes a first divided piece 352 and a second divided piece 362. The third leaf spring 43 includes a first divided piece 353 and a second divided piece 363. The plurality of first divided pieces 351 to 353 are laminated on each other to constitute the first divided piece 35 of the contact piece 22 described above. The plurality of second divided pieces 361 to 363 are laminated on each other to constitute the second divided piece 36 of the contact piece 22 described above.

The first leaf spring 41, the second leaf spring 42, and the third leaf spring 43 include first contact attaching portions 441, 442, and 443, respectively. The first contact attaching portions 441 to 443 are attachment holes formed in the first to third leaf springs 41 to 43, respectively, and are so disposed as to overlap with each other. The first movable contact 23 is attached to the first contact attaching portions 441 to 443.

The first leaf spring 41, the second leaf spring 42, and the third leaf spring 43 include second contact attaching portions 451, 452, and 453, respectively. The second contact attaching portions 451 to 453 are attachment holes formed in the first to third leaf springs 41 to 43, respectively, and are so disposed as to overlap with each other. The second movable contact 24 is attached to the second contact attaching portions 451 to 453.

The first leaf spring 41 includes the first slit 461 described above. The first slit 461 is formed around the first contact attaching portion 441. The first slit 461 has a shape curved along a part of the first contact attaching portion 441. The second leaf spring 42 includes a second slit 462. The second slit 462 is formed around the first contact attaching portion 442. The second slit 462 has a shape curved along a part of the first contact attaching portion 442. The third leaf spring 43 includes a third slit 463. The third slit 463 has a shape similar to the shape of the first slit 461.

The first leaf spring 41, the second leaf spring 42, and the third leaf spring 43 include slits 371 to 373, respectively. The slits 371 to 373 are so disposed as to overlap with each other, and constitute the slit 37 described above. The first leaf spring 41, the second leaf spring 42, and the third leaf spring 43 include slits 381 to 383, respectively. The slits 381 to 383 are so disposed as to overlap with each other, and constitute the slit 38 described above.

The first leaf spring 41, the second leaf spring 42, and the third leaf spring 43 include expanded portions 391 to 393, respectively. The expanded portions 391 to 393 are so disposed as to overlap with each other, and constitute the expanded portion 39 described above.

The first leaf spring 41 includes the projection 621 described above. The first leaf spring 41 includes the tapered portion 641 described above. The first leaf spring 41 includes the first contact portion 412 and the second contact portion 413 described above.

The second leaf spring 42 includes the third contact portion 422 and the fourth contact portion 423 described above. The second leaf spring 42 includes a tapered portion 642 having a shape similar to a shape of the tapered portion 641 of the first leaf spring 41. The fourth contact portion 423 is provided at a leading end of the tapered portion 642 of the second leaf spring 42.

The second leaf spring 42 includes a projection 622 having a shape different from the shape of the projection 621 of the first leaf spring 41. The projection 622 of the second leaf spring 42 projects in the lengthwise direction. The projection 622 of the second leaf spring 42 overlaps with the first leaf spring 41 in a direction perpendicular to a surface of the contact piece 22. The third contact portion 422 is provided at a leading end of the projection 622 of the second leaf spring 42.

A leading end portion of the second leaf spring 42 is bent toward the movable contact terminal 21. This configuration stabilizes a contact pressure of the contacts in the set state of the relay 1.

The third leaf spring 43 includes a projection 623 having a shape similar to the shape of the projection 621 of the first leaf spring 41. The third leaf spring 43 includes a tapered portion 643 having a shape similar to the shape of the tapered portion 641 of the first leaf spring 41. A rib 432 is provided on the third leaf spring 43. The rib 432 is provided at an edge of the second divided piece 363 of the third leaf spring 43, and extends in the lengthwise direction of the contact piece 22. The rib 432 has a shape bent toward the movable contact terminal 21.

The movable contact terminal 21 includes a connection portion 51, a body 52, a recess 53, and a distal end portion 54. The connection portion 51 includes the proximal end portion 32 of the movable contact terminal 21. The connection portion 51 includes the connection projections 211 described above. The proximal end portion 33 of the contact piece 22 is connected with the connection projections 211.

The body 52 extends in the lengthwise direction of the contact piece 22 from the connection portion 51. As illustrated in FIGS. 4 to 6, the body 52 faces the expanded portion 39 of the contact piece 22. The body 52 includes a bent portion 521 having a bent shape. A proximal end side of the body 52 with respect to the bent portion 521 is inclined toward the contact piece 22 with nearness to the proximal end portion 32.

The recess 53 overlaps with a portion of the contact piece 22 on a leading end side with respect to the first movable contact 23. The recess 53 is located between the body 52 and the distal end portion 54. As illustrated in FIG. 2, the link member 6 is so disposed as to pass through the recess 53.

The distal end portion 54 is located on a leading end side of the recess 53. The distal end portion 54 includes the leading end portion 31 of the movable contact terminal 21. The distal end portion 54 is constituted by the movable contact terminal 21 at a portion projecting to the outside of the base 2.

Figure 10:
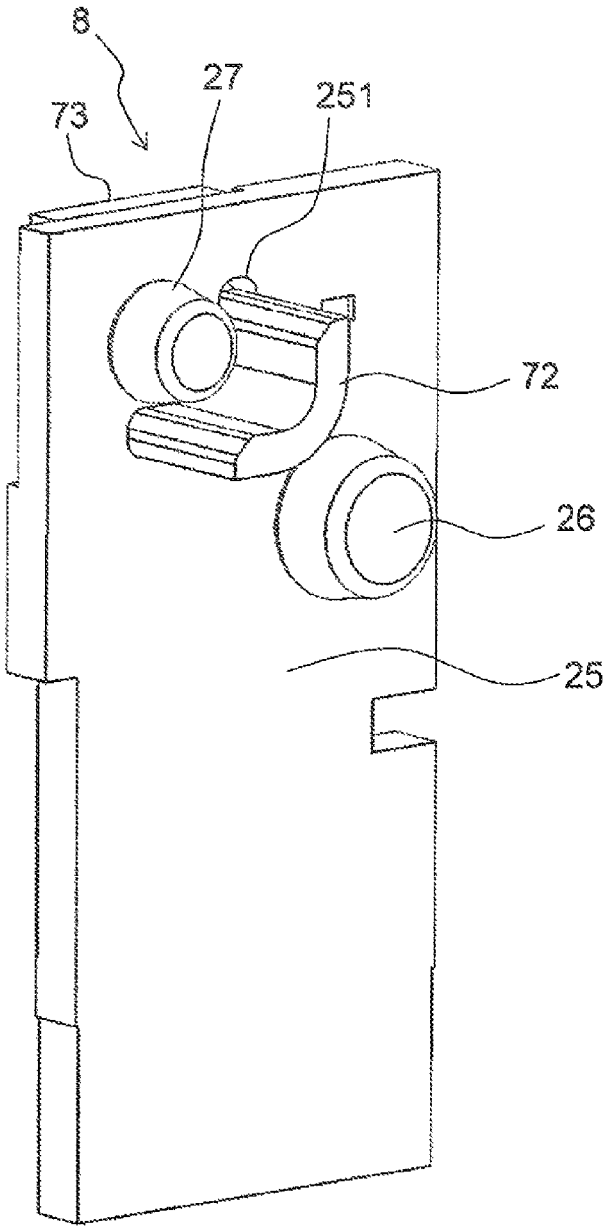
FIG. 10 is a perspective view of a fixed contact unit.
Figure 11:
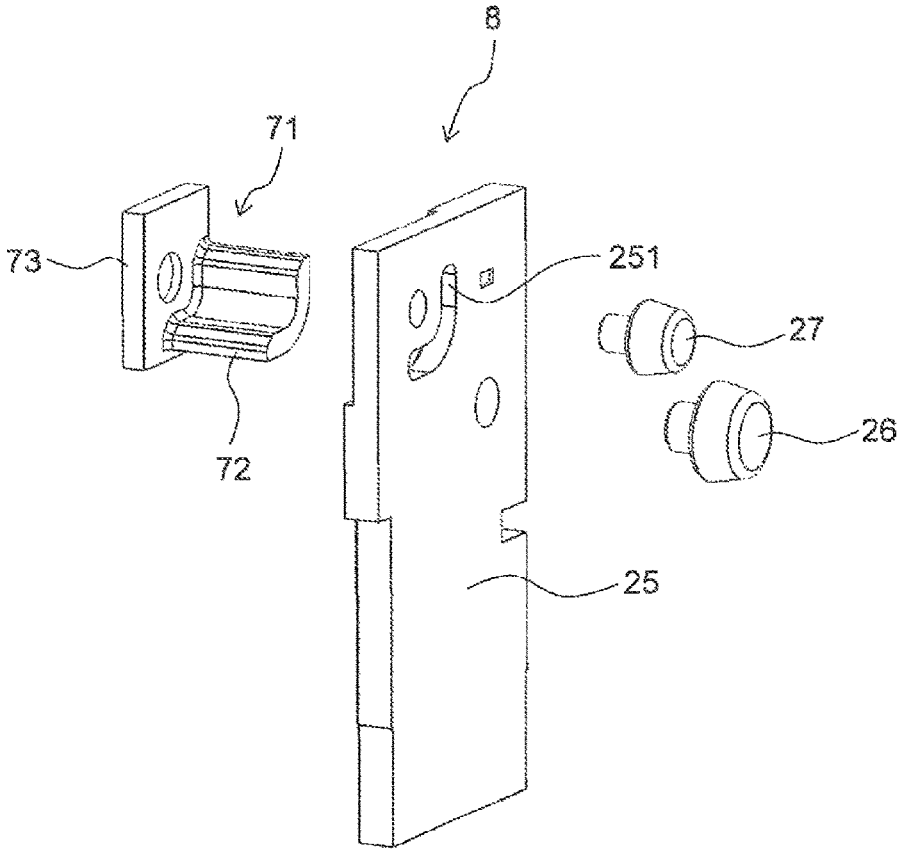
FIG. 11 is an exploded perspective view of the fixed contact unit.
Figure 12:
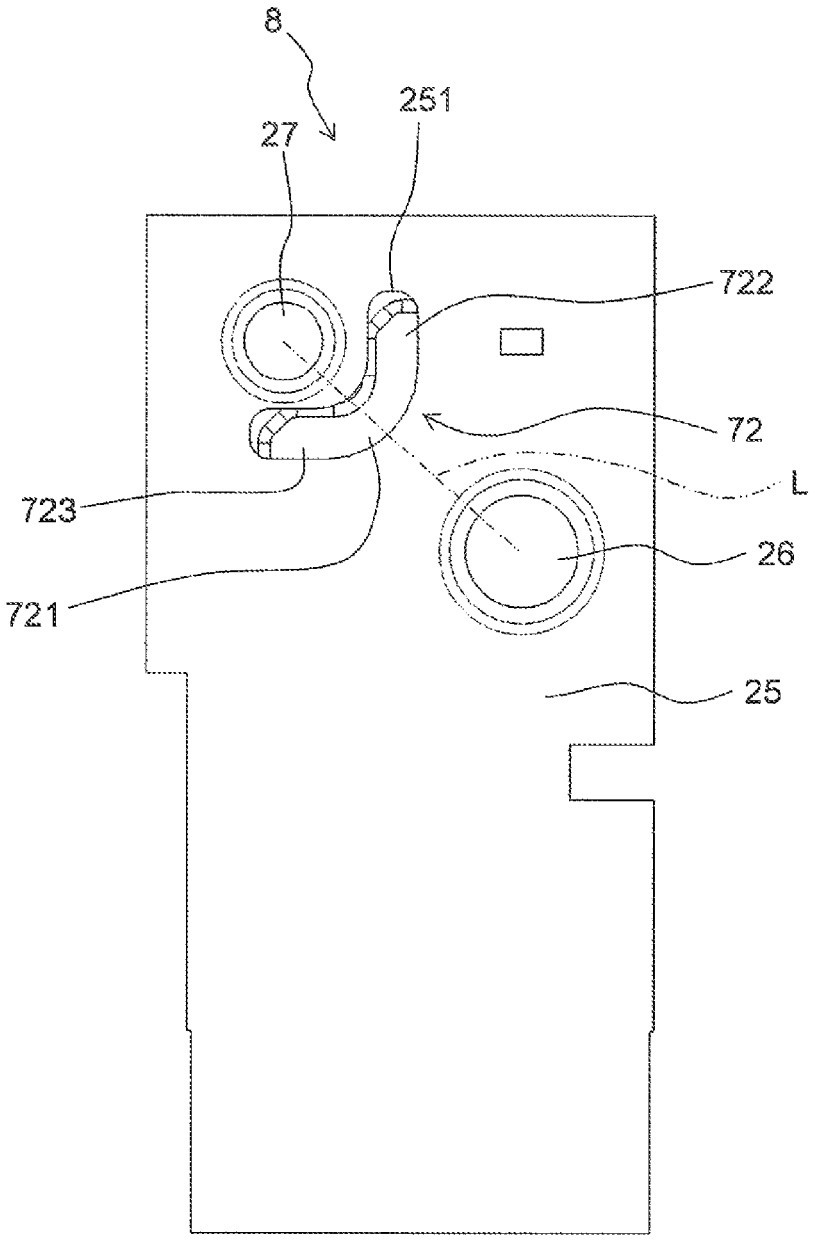
FIG. 12 is a side view of the fixed contact unit.
Figure 13:
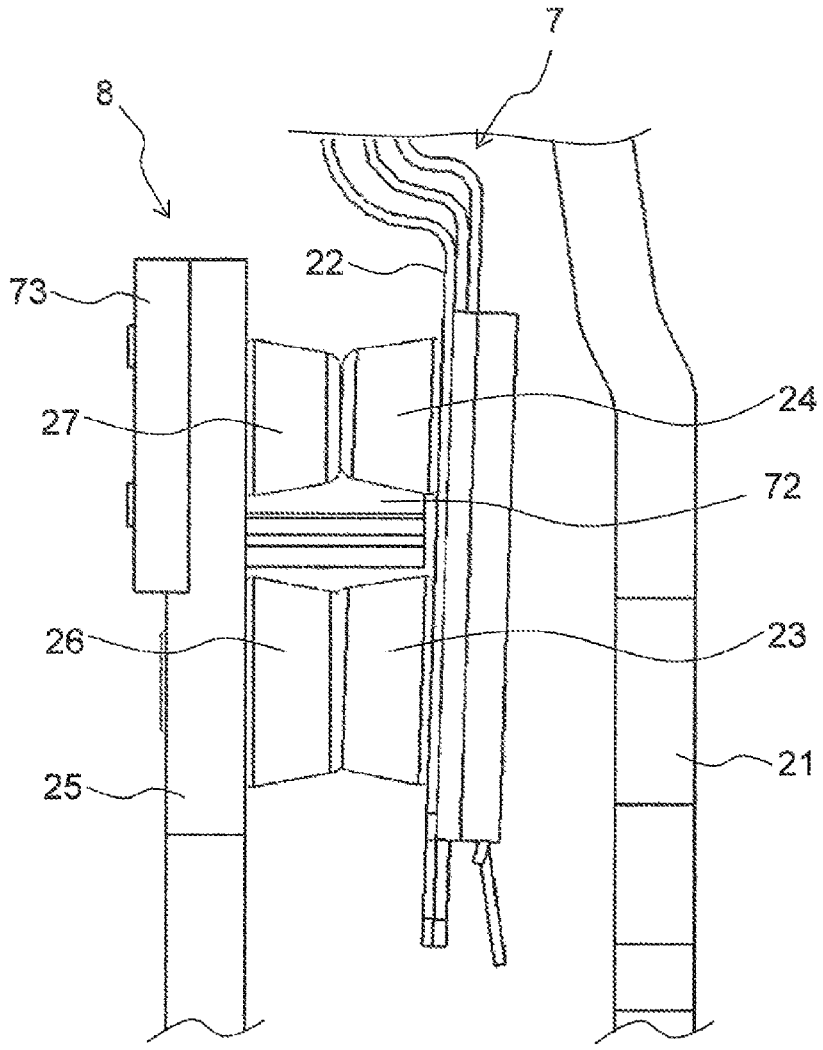
FIG. 13 is an enlarged view of the fixed contact unit and the contact piece unit.

Next, the fixed contact unit 8 is described. FIG. 10 is a perspective view of the fixed contact unit 8. FIG. 11 is an exploded perspective view of the fixed contact unit 8. FIG. 12 is a side view of the fixed contact unit 8. FIG. 13 is an enlarged view of the contact piece unit 7 and the fixed contact unit 8.

As illustrated in FIGS. 10 to 13, the fixed contacts 26 and 27 include the first fixed contact 26 and the second fixed contact 27, respectively. The first fixed contact 26 is attached to the fixed contact terminal 25, and disposed at a position facing the first movable contact 23. The second fixed contact 27 is attached to the fixed contact terminal 25, and disposed at a position facing the second movable contact 24. The first fixed contact 26 and the second fixed contact 27 are disposed away from each other in the lengthwise direction of the contact piece 22 similarly to the first movable contact 23 and the second movable contact 24. The first fixed contact 26 is disposed on a leading end side of the contact piece 22 with respect to the second fixed contact 27.

A diameter of the first fixed contact 26 is larger than a diameter of the second fixed contact 27. As illustrated in FIG. 13, a height of the first fixed contact 26 from the fixed contact terminal 25 is larger than a height of the second fixed contact 27 from the fixed contact terminal 25. As described above, the height of the first movable contact 23 from the contact piece 22 is larger than the height of the second movable contact 24 from the contact piece 22.

Accordingly, at the time of contact between the contacts, the first movable contact 23 comes into contact with the first fixed contact 26 prior to contact between the second movable contact 24 and the second fixed contact 27. At the time of separation between the contacts, the first movable contact 23 separates from the first fixed contact 26 after separation of the second movable contact 24 from the second fixed contact 27. Accordingly, an electric load produced at the time of contact between the contacts or separation between the contacts is chiefly applied to the first movable contact 23. Each of the first movable contact 23 and the first fixed contact 26 therefore functions as an open/close contact. On the other hand, each of the second movable contact 24 and the second fixed contact 27 functions as an energization contact.

As illustrated in FIG. 11, the fixed contact unit 8 includes a wall member 71. The wall member 71 is a component separated from the fixed contact terminal 25, and attached to the fixed contact terminal 25. The wall member 71 includes a wall 72 and an attachment portion 73. The wall 72 is so provided as to project from the attachment portion 73. The attachment portion 73 has a plate shape. The attachment portion 73 is attached to a surface of the fixed contact terminal 25 on the side opposite to a surface facing the contact piece 22.

The fixed contact terminal 25 includes a slit 251. The wall 72 is so disposed in such a position as to pass through the slit 251. The wall 72 projects toward the contact piece 22 from the surface of the fixed contact terminal 25. As illustrated in FIG. 12, the wall 72 is disposed between the first fixed contact 26 and the second fixed contact 27. The wall 72 includes a curved portion 721, a first linear portion 722, and a second linear portion 723.

The curved portion 721 is curved in such a shape as to surround the second fixed contact 27. A virtual line L connecting a center of the first fixed contact 26 and a center of the second fixed contact 27 overlaps with the curved portion 721 as viewed in a direction perpendicular to the surface of the fixed contact terminal 25. A distance between the first fixed contact 26 and the wall 72 is longer than a distance between the second fixed contact 27 and the wall 72. More specifically, the distance between the first fixed contact 26 and the wall 72 is longer than the distance between the second fixed contact 27 and the wall 72 on the virtual line L.

The first linear portion 722 extends in the lengthwise direction from the curved portion 721. The first linear portion 722 is located between the first fixed contact 26 and the second fixed contact 27 in the widthwise direction. The second linear portion 723 extends in the widthwise direction from the curved portion 721. The second linear portion 723 is located between the first fixed contact 26 and the second fixed contact 27 in the lengthwise direction.

As illustrated in FIG. 13, a height of the wall 72 from the surface of the fixed contact terminal 25 is larger than a height of the first fixed contact 26. The height of the wall 72 from the surface of the fixed contact terminal 25 is larger than a height of the second fixed contact 27. The height of the wall 72 from the surface of the fixed contact terminal 25 is smaller than a distance between the contact piece 22 and the fixed contact terminal 25 in the set state.

According to the relay described above in the embodiment, the first movable contact 23 functions as an open/close movable contact, while the second movable contact 24 functions as an energization movable contact. The first movable contact 23 is located on a leading end side of the contact piece 22 with respect to the second movable contact 24. In this case, the first movable contact 23 can be largely displaced at the time of press by the link member 6. Accordingly, detaching force for detaching the first movable contact 23 from the first fixed contact 26 can be increased.

Moreover, the first contact portion 412 is provided on the projection 621 projecting in the widthwise direction from the first body 611. In this case, a distance between the first contact portion 412 and the first movable contact 23 can be increased. Accordingly, force applied to the first movable contact 23 by press of the link member 6 against the first contact portion 412 can be increased, whereby the detaching force can be increased.

The positions of the first movable contact 23 and the second movable contact 24 deviate from each other in the lengthwise direction. In this case, the widthwise size of the contact piece 22 can be decreased while securing a distance between the first movable contact 23 and the second movable contact 24, compared with a configuration where the first movable contact 23 and the second movable contact 24 are lined in the widthwise direction. Accordingly, the size of the relay 1 can be reduced.

Furthermore, the long distance left between the first movable contact 23 and the second movable contact 24 reduces adhesion of scatterings from the first movable contact 23 and the first fixed contact 26 to the second movable contact 24 and the second fixed contact 27 at the time of generation of an arc between the first movable contact 23 and the first fixed contact 26. Accordingly, contact stability between the second movable contact 24 and the second fixed contact 27 can be improved.

The deviation between the positions of the first movable contact 23 and the second movable contact 24 in the lengthwise direction allows visual recognition of the first movable contact 23 and the second movable contact 24 in the widthwise direction of the contact piece 22 in a state that the contact piece unit 7 and the fixed contact unit 8 are housed in the base 2 as illustrated in FIG. 2. The first fixed contact 26 and the second fixed contact 27 are also visually recognizable in the housed state inside the base 2. Accordingly, gaps between the respective contacts are easily measurable.

The first contact portion 412 is provided at a leading end of the first divided piece 35. Accordingly, the detaching force can be increased by large displacement of the first movable contact 23.

The first contact portion 412 deviates in the widthwise direction from the position of the first movable contact 23. Accordingly, the detaching force can be increased by twisting deformation of the first divided piece 35.

The projection 621 is disposed at a position facing the recess 651 of the second divided piece 36. Accordingly, the width of the contact piece 22 does not increase even in the presence of the projection 621 on the first divided piece 35.

The wall 72 is disposed between the first fixed contact 26 and the second fixed contact 27. Accordingly, the wall 72 further reduces adhesion of scatterings to the second movable contact 24 and the second fixed contact 27 even at the time of generation of an arc between the first movable contact 23 and the first fixed contact 26. Accordingly, contact stability between the second movable contact 24 and the second fixed contact 27 can be improved.

As illustrated in FIG. 2, the wall 72 covers the second fixed contact 27 from the base 2 side in the widthwise direction, but does not cover the second fixed contact 27 from the side opposite to the base 2. In this case, the second fixed contact 27 is not blocked by the wall 72 and is visually recognizable in the state that the contact piece unit 7 and the fixed contact unit 8 are housed in the base 2. Accordingly, the presence of the wall 72 does not obstruct measurement of gaps between the contacts.

The height of the wall 72 from the surface of the fixed contact terminal 25 is larger than each of the height of the first fixed contact 26 and the height of the second fixed contact 27. This configuration effectively reduces adhesion of scatterings to the second movable contact 24 and the second fixed contact 27.

The height of the wall 72 is smaller than the distance between the contact piece 22 and the fixed contact terminal 25 in the set state. This configuration reduces interference between the wall 72 and the contact piece 22.

The wall 72 includes the curved portion 721 curved in such a shape as to surround the second fixed contact 27. This configuration secures a wide space for an arc generable area around the first fixed contact 26 and the first movable contact 23. Accordingly, electric durability between the first fixed contact 26 and the first movable contact 23 can be improved.

The virtual line connecting the center of the first fixed contact 26 and the center of the second fixed contact 27 overlaps with the curved portion 721 as viewed in the direction perpendicular to the surface of the fixed contact terminal 25. In this case, the curved portion 721 is located between the center of the first fixed contact 26 and the center of the second fixed contact 27. Accordingly, a wide space can be secured around the first fixed contact 26 and the first movable contact 23.

The present invention is not limited to the embodiment described herein as a specific embodiment of the present invention. Various modifications may be made without departing from the scope of the subject matters of the invention.

The configuration of the contact piece unit 7 may be modified from the configuration described above in the embodiment. For example, the shape of the contact piece 22 may be modified. The shapes or positions of the first to fourth contact portions 412, 413, 422, and 423 may be modified. The shapes or positions of the movable contacts 23 and 24 may be modified.

The configuration of the fixed contact unit 8 may be modified from the configuration described above in the embodiment. For example, the shapes or positions of the fixed contacts 26 and 27 may be modified. The shape or position of the wall 72 may be modified. The wall 72 may be formed integrally with the fixed contact terminal 25.

Figure 14:
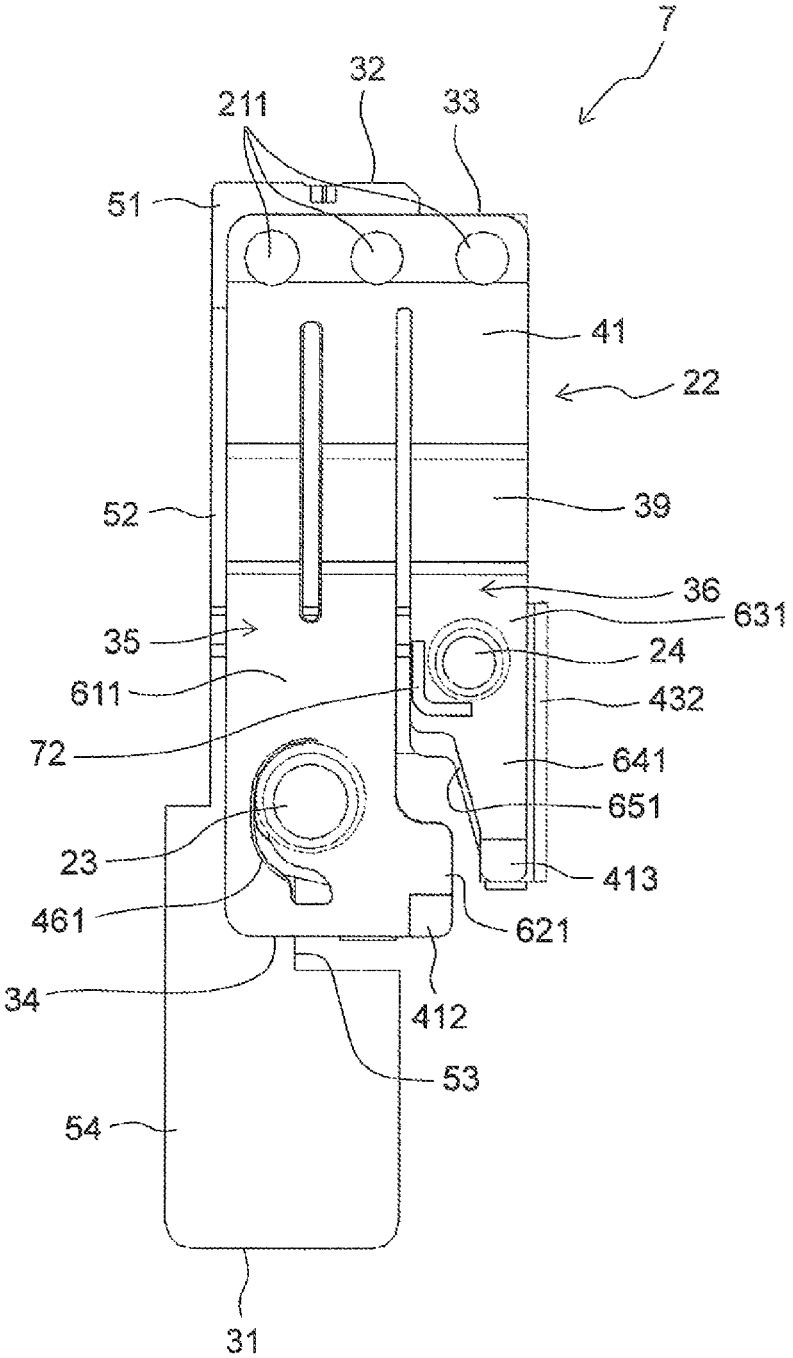
FIG. 14 is a side view of a contact piece unit according to another embodiment.

The wall 72 may be provided on the contact piece unit 7 as illustrated in FIG. 14. In this case, the wall 72 may be projected from the surface of the contact piece 22, and disposed between the first movable contact 23 and the second movable contact 24. A height of the wall 72 from the surface of the contact piece 22 may be larger than the height of the first movable contact 23 similarly to the wall 72 illustrated in FIG. 13. The height of the wall 72 from the surface of the contact piece 22 may be larger than the height of the second movable contact 24.

INDUSTRIAL APPLICABILITY

According to the present invention, operation stability of a relay can be improved by increasing detaching force for detaching an open/close movable contact from an open/close fixed contact at the time of welding between the open/close movable contact and the open/close fixed contact.

DESCRIPTION OF SYMBOLS

21 movable contact terminal
22 contact piece
35 first divided piece
36 second divided piece
23 first movable contact
24 second movable contact
25 fixed contact terminal
26 first fixed contact
27 second fixed contact
6 link member
611 first body
621 projection
412 first contact portion
651 recess
72 wall
721 curved portion

The invention claimed is:

1. A relay comprising:
a movable contact terminal;
a contact piece that is attached to the movable contact terminal, and includes a first divided piece and a second divided piece extending in a lengthwise direction and divided from each other;
a first movable contact attached to the first divided piece;
a second movable contact attached to the second divided piece;
a fixed contact terminal disposed at a position facing the contact piece;
a first fixed contact attached to the fixed contact terminal and disposed at a position facing the first movable contact;
a second fixed contact attached to the fixed contact terminal and disposed at a position facing the second movable contact; and
a link member capable of pressing the contact piece, wherein
at a time of contact between the contacts, the first movable contact comes into contact with the first fixed contact before the second movable contact comes into contact with the second fixed contact,
the first movable contact is located on a leading end side of the contact piece with respect to the second movable contact,
the first divided piece includes
a body that extends in the lengthwise direction, and
a projection that projects in a widthwise direction of the first divided piece from the body, and
the projection includes a contact portion pressed by the link member.

2. The relay according to claim 1, wherein the contact portion is disposed at a position deviating in the widthwise direction from the first movable contact.

3. The relay according to claim 1, wherein the contact portion is located at a portion of the first divided piece on a leading end side with respect to at least a part of the first movable contact.

4. The relay according to claim 3, wherein the contact portion is provided at a leading end of the first divided piece.

5. The relay according to claim 1, wherein the second divided piece includes a recess provided at a position facing the projection.

6. The relay according to claim 1, further comprising a wall projected from a surface of the fixed contact terminal, and disposed between the first fixed contact and the second fixed contact.

7. The relay according to claim 6, wherein a height of the wall from the surface of the fixed contact terminal is larger than a height of the first fixed contact, or a height of the second fixed contact.

8. The relay according to claim 6, wherein the height of the wall is smaller than a distance between the contact piece and the fixed contact terminal in a state of contact between the first movable contact and the first fixed contact.

9. The relay according to claim 6, wherein the wall includes a curved portion curved in such a shape as to surround the second fixed contact.

10. The relay according to claim 9, wherein a virtual line that connects a center of the first fixed contact and a center of the second fixed contact overlaps with the curved portion as viewed in a direction perpendicular to the surface of the fixed contact terminal.

11. The relay according to claim 1, further comprising a wall projected from a surface of the contact piece, and disposed between the first movable contact and the second movable contact.

12. The relay according to claim 1, wherein a height of the first movable contact from the contact piece is larger than a height of the second movable contact from the contact piece.

13. The relay according to claim 1, wherein a height of the first fixed contact from the fixed contact terminal is larger than a height of the second fixed contact from the fixed contact terminal.

* * * * *